US012560164B2

(12) United States Patent
Shibasaki

(10) Patent No.: US 12,560,164 B2
(45) Date of Patent: Feb. 24, 2026

(54) RECIPROCATING PUMP

(71) Applicant: MARUYAMA MFG. CO., INC., Tokyo (JP)

(72) Inventor: Atsushi Shibasaki, Tokyo (JP)

( * ) Notice: Subject to any disclaimer, the term of this patent is extended or adjusted under 35 U.S.C. 154(b) by 53 days.

(21) Appl. No.: 18/512,057

(22) Filed: Nov. 17, 2023

(65) Prior Publication Data

US 2024/0209853 A1 Jun. 27, 2024

(30) Foreign Application Priority Data

Dec. 23, 2022 (JP) ..... 2022-206710

(51) Int. Cl.

| | |
|---|---|
| ***F04B 53/02*** | (2006.01) |
| ***F04B 19/22*** | (2006.01) |
| ***F04B 53/00*** | (2006.01) |
| ***F04B 53/16*** | (2006.01) |
| ***F04B 53/22*** | (2006.01) |

(52) U.S. Cl.

CPC ..... *F04B 53/02* (2013.01); *F04B 19/22* (2013.01); *F04B 53/006* (2013.01); *F04B 53/007* (2013.01); *F04B 53/164* (2013.01); *F04B 53/22* (2013.01)

(58) Field of Classification Search

CPC ..... F04B 53/16; F04B 53/02; F04B 19/22; F04B 53/006; F04B 53/007; F04B 53/164; F04B 53/22; F04B 1/04; F04B 1/0408; Y10T 403/1616; Y10T 403/1624

See application file for complete search history.

(56) References Cited

U.S. PATENT DOCUMENTS

| | | | | |
|---|---|---|---|---|
| 4,556,371 A * | 12/1985 | Post | F04B 11/0066 | 417/539 |
| 4,824,342 A * | 4/1989 | Buck | F04B 53/1032 | 417/539 |
| 5,934,173 A * | 8/1999 | Murphy | F04B 53/164 | 74/579 E |
| 6,126,171 A * | 10/2000 | Vensland | F04B 53/164 | 277/516 |
| 6,517,274 B1 * | 2/2003 | Watanabe | F02F 1/24 | 403/14 |
| 2017/0058890 A1 * | 3/2017 | Kaneko | F04B 1/00 | |

FOREIGN PATENT DOCUMENTS

| | | | |
|---|---|---|---|
| JP | S59182680 | * 12/1984 | F04B 21/00 |
| JP | 2021-004604 | 1/2021 | |

OTHER PUBLICATIONS

Merriam-webster.com; Sandwiched Definition & Meaning—Merriam-Webster; merriam-webster.com/dictionary/sandwiched (Year: 2025).*

* cited by examiner

*Primary Examiner* — David N Brandt
(74) *Attorney, Agent, or Firm* — SHIPWAY IP

(57) ABSTRACT

A reciprocating pump includes a case body having a reciprocating member, a manifold having a cylinder portion through which at least a part of the reciprocating member is inserted, a fastening member which fastens the case body and the manifold, and a position regulating member which regulates a position of the manifold with respect to the case body. The position regulating member has a tubular shape having an axial direction along the first direction. The position regulating member is fitted to the case body and the manifold. The fastening member fastens the case body and the manifold in a state of being inserted into the position regulating member.

16 Claims, 5 Drawing Sheets

RECIPROCATING PUMP

CROSS-REFERENCE TO RELATED APPLICATIONS

This application is based upon and claims the benefit of priority from Japanese Patent Application No. 2022-206710, filed on Dec. 23, 2022, the entire contents of which are incorporated herein by reference.

BACKGROUND

Field

The present disclosure relates to a reciprocating pump.

Description of the Related Art

Japanese Unexamined Patent Application Publication No. 2021-4604 discloses a pump device. The pump device includes a housing that houses a motor and a pump, and the housing is fixed to an attachment target. The housing and the attachment target are positioned by a positioning pin.

SUMMARY

Disclosed herein is an example reciprocating pump. An example reciprocating pump includes a case body having a reciprocating member which reciprocates along a first direction, a manifold having a cylinder portion through which at least a part of the reciprocating member of the case body is inserted, a fastening member which fastens the case body and the manifold, and a position regulating member which regulates a position of the manifold with respect to the case body (10). The position regulating member has a tubular shape having an axial direction along the first direction. A first end of the position regulating member in the first direction is fitted to a first fitting portion formed in the case body. A second end of the position regulating member on a side opposite to the first end in the first direction is fitted to a second fitting portion formed in the manifold. The fastening member fastens the case body and the manifold in a state of being inserted into the position regulating member having the tubular shape.

In some examples, the case body and the manifold are positioned as the first end and the second end of the position regulating member are respectively fitted to the first fitting portion provided in the case body and the second fitting portion provided in the manifold, and the case body and the manifold are fastened by inserting the fastening member into the position regulating member. For example, the first fitting portion and the second fitting portion also serve as insertion holes of the fastening member. Since a dedicated region for the position regulating member is not provided, an increase in sizes of the manifold and the case body is suppressed.

In some examples, the case body includes a plurality of the reciprocating members disposed at equal intervals in a second direction intersecting the first direction. When viewed from the first direction, a pair of the position regulating members may be disposed at point-symmetrical positions with a center position between a pair of the reciprocating members disposed at both ends in the second direction as a reference. In addition, the pair of position regulating members may be disposed on a line along the second direction passing through the center position when viewed from the first direction. In addition, the pair of position regulating members may be disposed at positions sandwiching the plurality of reciprocating members in the second direction. In these configurations, occurrence of misalignment in assembly is suppressed.

The position regulating member may have a cylindrical shape. The first fitting portion and the second fitting portion may have a columnar space. A diameter of the first fitting portion may be configured to be smaller than a diameter of the second fitting portion. In these configurations, the position regulating member tends to remain in the first fitting portion when the case body and the manifold are disassembled.

In some examples, the manifold may include a first manifold fastened to the case body and a second manifold connected to the first manifold. The first manifold and the second manifold are connected to each other by a communication pipe. A seal member positioned in the first direction by the communication pipe is disposed in the cylinder portion of the first manifold. By omitting a seal case for accommodating the seal member, the size of the manifold may be decreased.

In some examples, the fastening member includes a threaded portion extending from the first end of the position regulating member and threaded to the case body, and a head portion configured to clamp the manifold between the head portion and the case body by screwing the threaded portion into the case body.

In some examples, the reciprocating members are located at both ends in the second direction as a reference. The position regulating members viewed from the first direction are located at point-symmetrical positions with a center position between the reciprocating members which are located at both ends in the second direction.

In some examples, the position regulating members are located in the second direction orthogonal to the first direction. In some examples, the reciprocating members are located in the second direction and at positions sandwiched by the position regulating members.

In some examples, a length of the fitting portion in the first direction is longer than a length of the second fitting portion in the first direction.

In some examples, the first manifold portion includes a first divided portion which is a part of the cylinder portion. The second manifold portion includes a second divided portion which is a part of the cylinder portion, and is fluidly coupled with the first divided portion.

In some examples, the manifold includes a communication pipe inserted in the first divided portion and the second divided portion. Additionally, the communication pipe fluidly couples with the first divided portion and the second divided portion.

In some examples, the reciprocating pump includes a seal member located in the first divided portion. The seal member abuts the communicating pipe and is positioned in the first direction by the communication pipe.

DETAILED DESCRIPTION

Figure 1:
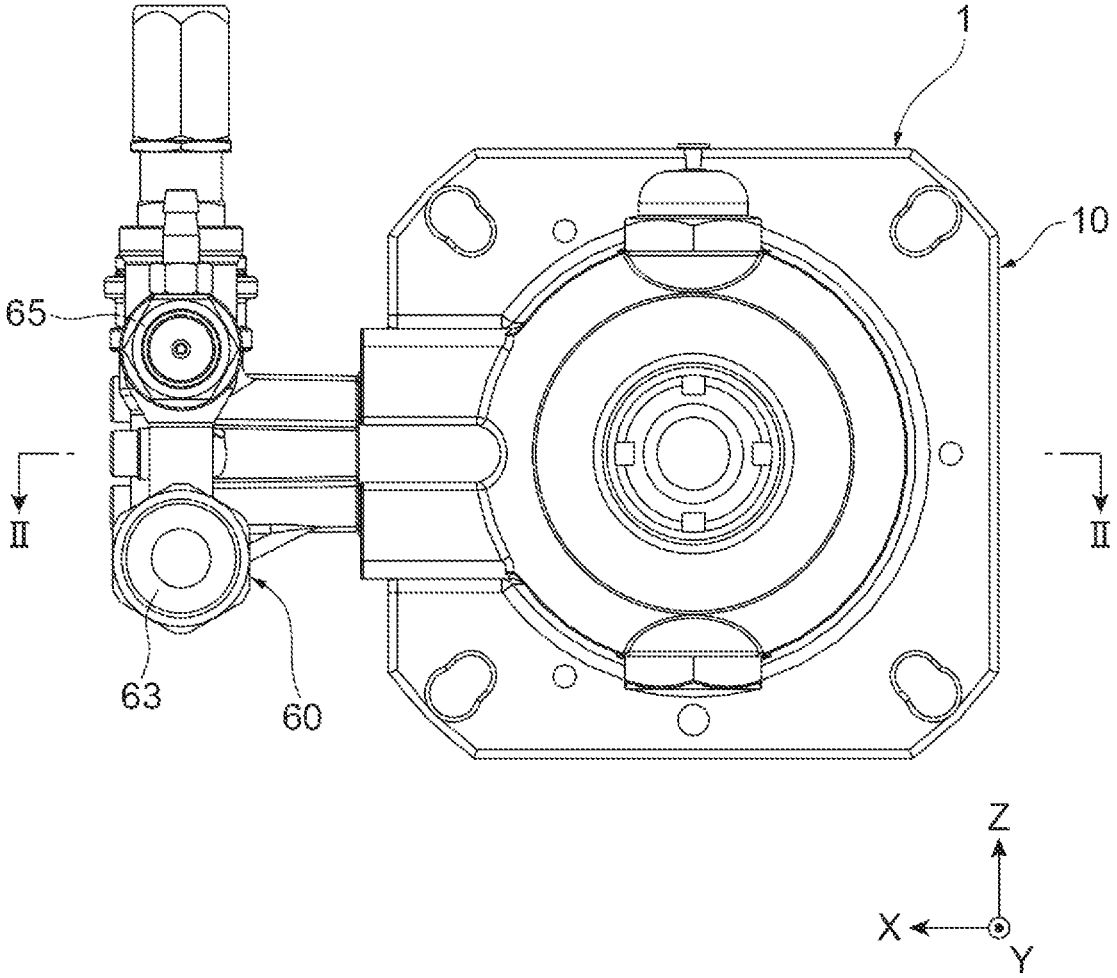
FIG. 1 is a side view of an example reciprocating pump.

In the following description, with reference to the drawings, the same reference numbers are assigned to the same components or to similar components having the same function, and overlapping description is omitted.

Hereinafter, an example reciprocating pump will be described with reference to the accompanying drawings. An example reciprocating pump is a so-called horizontal triplex plunger pump in which plungers forming reciprocating members are arranged in three parallel rows in a horizontal direction. In some examples, "up" and "down" are defined based on a state in which the reciprocating pump is placed on a horizontal plane, and "front" and "rear" are defined based on an axial direction of the reciprocating member such that a pump chamber side is defined as the front, and a crankcase side is defined as the rear. "Left" and "right" are based on the front-rear direction of the reciprocating pump placed on the horizontal plane.

In the drawings, an XYZ orthogonal coordinate system is illustrated for reference. An X direction corresponds to the front-rear direction (an axial direction) of the reciprocating pump, a Y direction corresponds to the left-right direction, and a Z direction corresponds to the up-down direction. In some examples, the X direction is an example of a first direction, the Y direction is an example of a second direction, and the Z direction is an example of a third direction. The second direction and the third direction may intersect the first direction. The second direction may orthogonal to the first direction.

Figure 2:
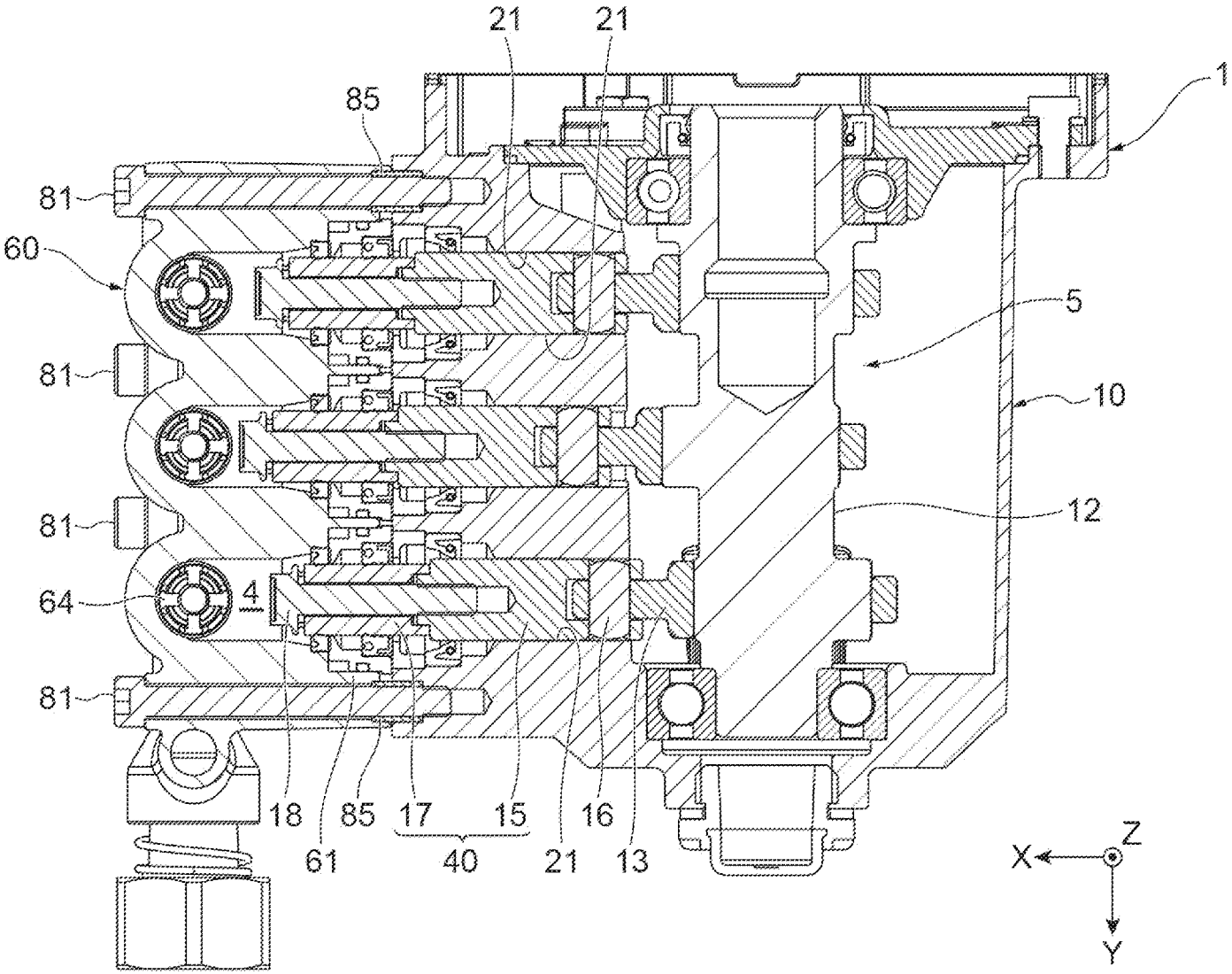
FIG. 2 is a cross-sectional view taken along line II-II of FIG. 1.
Figure 3:
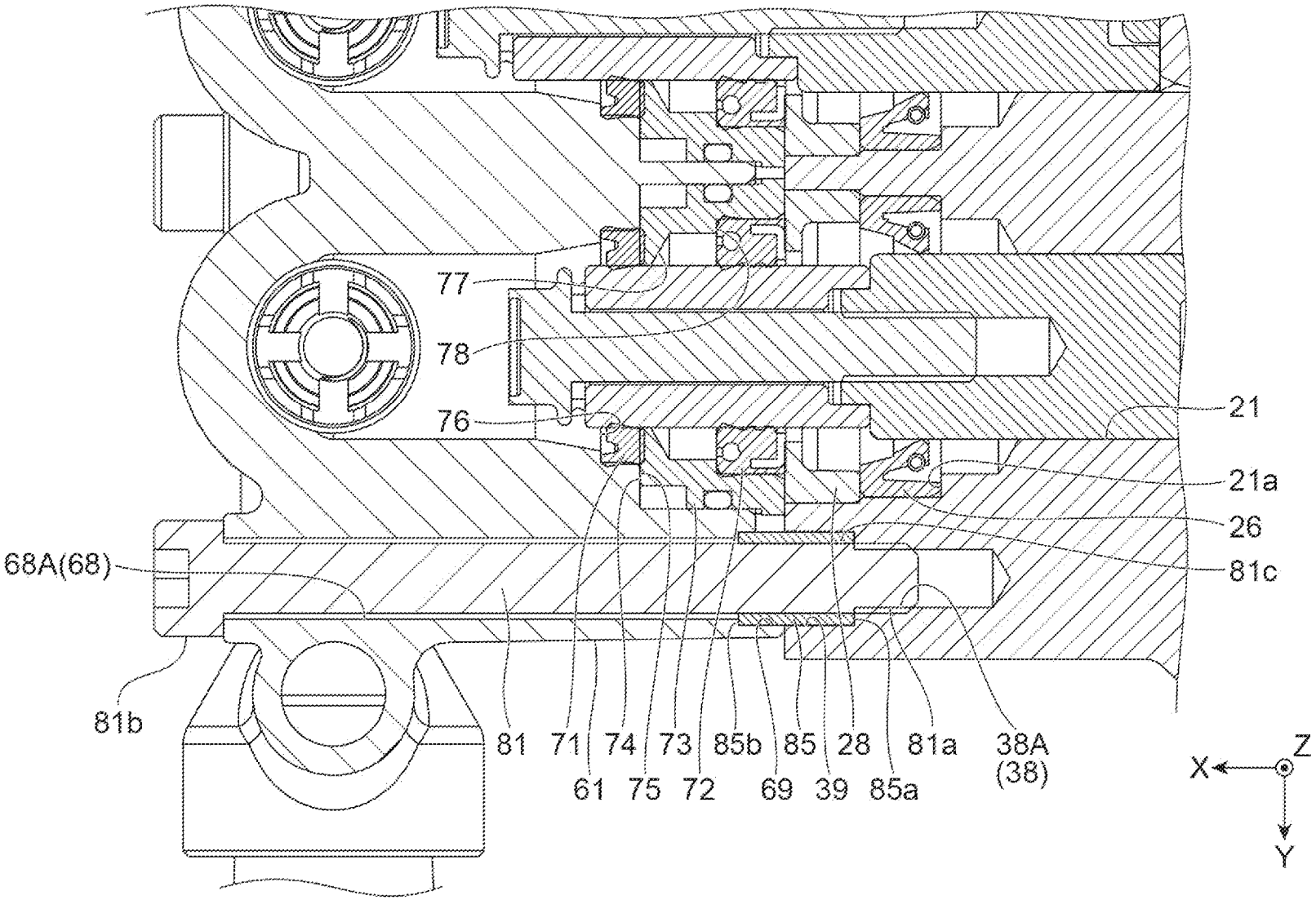
FIG. 3 is a partially enlarged view of FIG. 2.
Figure 4:
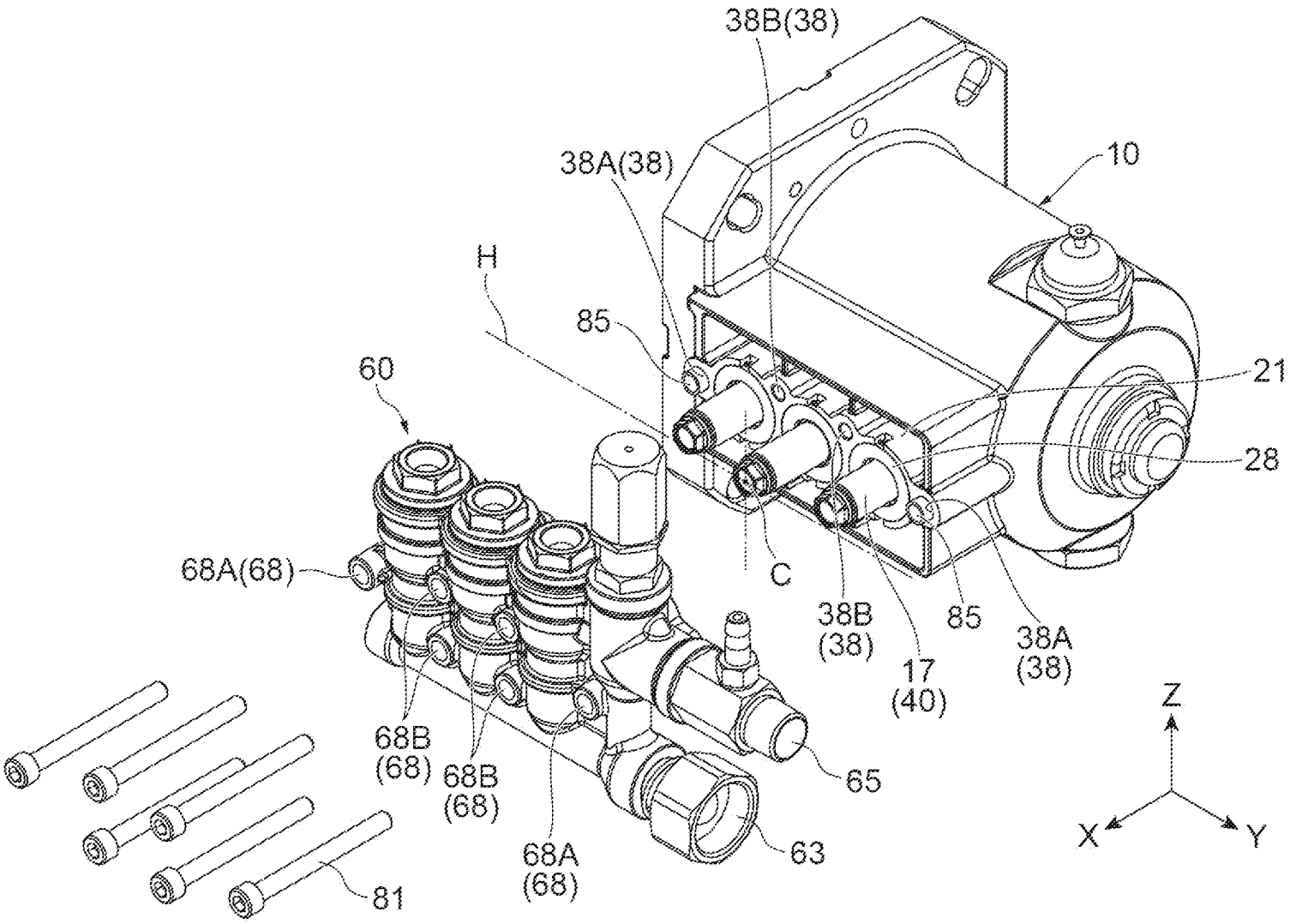
FIG. 4 is an exploded perspective view of an example reciprocating pump.

FIG. 1 is a side view of an example reciprocating pump. FIG. 2 is a cross-sectional view taken along line II-II of FIG. 1, and FIG. 3 is an enlarged view of FIG. 2. FIG. 4 is an exploded perspective view of an example reciprocating. In some examples, the reciprocating pump is a plunger pump, and may be a so-called horizontal triplex plunger pump in which plungers 17 forming reciprocating members 40 are arranged in three parallel rows in the horizontal direction.

As illustrated in FIGS. 1 and 2, a reciprocating pump 1 includes a case body (e.g., a crankcase 10) and a manifold 60 connected to the crankcase 10. In the reciprocating pump 1 illustrated in FIG. 2, the reciprocating member 40 disposed in the crankcase 10 and the manifold 60 reciprocates to perform a pumping action in a pump chamber 4 in the manifold 60.

The crankcase 10 is hollow. In the crankcase 10, a crankshaft 12, a connecting rod 13 rotatably connected to the crankshaft 12, a piston pin 16 rotatably connecting a plunger rod 15 to the connecting rod 13, and the like are disposed, thereby forming a driving part 5 that reciprocally drives the reciprocating member 40 along an axis extending in the X direction. As the crankshaft 12 rotates, the connecting rod 13 and the piston pin 16 operate, and the reciprocating member 40 reciprocates in the front-rear direction inside a cylinder portion 21.

The plunger rod 15 forms a rear half of the reciprocating member 40. The plunger 17 forming a front half of the reciprocating member 40 is connected to a front portion of the plunger rod 15 by a bolt 18. In the reciprocating pump 1 illustrated in FIG. 2, three reciprocating members 40 extending in the X direction are arranged in parallel at equal intervals in the Y direction. Heights of axes of the three reciprocating members 40 in the Z direction coincide with each other. The three reciprocating members 40 are formed on the same horizontal plane. Unless otherwise particularly described below, height positions of the axes of the three reciprocating members 40 in the Z direction are referred to as a "reference height H", and a position of the axis of the reciprocating member 40 disposed at the center in the Y direction is referred to as a "center position C".

The crankcase 10 includes the cylinder portion 21. The cylinder portion 21 has a cylindrical shape and opens toward the front side of the crankcase 10. An axial direction (e.g., the X direction) of the cylinder portion 21 is orthogonal to an axial direction (e.g., the Y direction) of the crankshaft 12. The piston pin 16 and a distal end of the connecting rod 13 can be disposed inside the cylinder portion 21. In the illustrated example, the three cylinder portions 21 are arranged in parallel in the Y direction.

The crankcase 10 is filled with oil for lubricating and cooling the driving part 5. A seal portion (e.g., an oil seal 26) configured to prevent leakage of the oil in the crankcase 10 is disposed inside the cylinder portion 21. The oil seal 26 is in sliding contact with an outer peripheral surface of the plunger rod 15 forming the reciprocating member 40 in a liquid-tight manner. An end surface of the oil seal 26 on a side closer to the driving part 5 is in contact with an annular stepped surface 21*a* inside the cylinder portion 21. An annular positioning member 28 is disposed on an end surface of the oil seal 26 on a side closer to the manifold 60.

In the manifold 60, a cylinder portion 61 in which the plunger 17 reciprocates is formed, and the pump chamber 4 is formed on a distal end side of the cylinder portion 61. The manifold 60 is further provided with a suction port 63 configured to introduce a use liquid, such as water, into the pump chamber 4, and a discharge port 65 configured to discharge the use liquid compressed in the pump chamber 4. The suction port 63 and the discharge port 65 are connected by a flow passage. A suction valve 64 is provided in the flow passage on a side closer to the suction port 63, and a discharge valve is provided in the flow passage on a side closer to the discharge port 65. A portion of the flow passage between the suction valve 64 and the discharge valve is connected to the pump chamber 4.

A seal member (e.g., a ring-shaped U-packing 71) functioning as a high-pressure seal and a packing (e.g., a ring-shaped U-packing 72) functioning as a low-pressure seal are disposed in the cylinder portion 61 of the manifold 60. Each of the U-packings 71 and 72 prevent the use liquid from flowing between each of the U-packings 71 and 72 and an outer peripheral surface of the plunger 17 and leaking from the pump chamber 4 to the outside. The U-packings 71 and 72 are disposed so as to be in sliding contact with the outer peripheral surface of the plunger 17 in a liquid-tight manner. The U-packing 71 is disposed at a position closer to the pump chamber 4 than the U-packing 72. The U-packing 71 and the U-packing 72 are separated from each other in the X direction. These U-packings 71 and 72 can be molded using, for example, an elastic material such as rubber.

The U-packing 72 as a sealing unit is accommodated in a seal case 73 disposed in the manifold 60. The seal case 73 may have a substantially cylindrical shape. As illustrated in FIG. 3, an end 74 of the seal case 73 on a side closer to the pump chamber 4 is in contact with a stepped surface 75 formed in the manifold 60. The U-packing 71 on the side closer to the pump chamber 4 is disposed so as to be sandwiched between the end 74 of the seal case 73 on the side closer to the pump chamber 4 and a stepped surface 76 in the manifold 60.

An inner peripheral surface of the seal case 73 is enlarged in diameter in two stages from the end 74 on the side closer to the pump chamber 4 toward side closer to the driving part 5 via an inclined surface 77 and a stepped surface 78, and the U-packing 72 is disposed in a region on the side closer to the driving part 5 than the stepped surface 78. The crankcase 10 and the manifold 60 are fastened to each other by a plurality of fastening members 81. For example, the fastening members 81 are six bolts. The fastening member 81 has a first coupling portion 81*a* coupled to the crankcase 10 and a second coupling portion 81*b* coupled to the manifold 60. The manifold 60 has through-holes 68 through which the fastening members 81 are inserted, and the crankcase 10 has threaded fastening holes 38 to which the fastening members 81 are fastened at the same positions as the through-holes 68 when viewed from the X direction.

In some examples, the fastening holes 38 may be disposed to be bilaterally symmetrical and vertically symmetrical when viewed from the X direction. For example, the plurality of fastening holes 38 includes two fastening holes 38A and four fastening holes 38B. The fastening holes 38A are formed at positions (both ends in the Y direction) sandwiching the three cylinder portions 21 in the Y direction. The fastening holes 38A are located at positions sandwiching the reciprocating members 40. Two fastening holes 38B are formed in each portion between the cylinder portions 21 adjacent to each other in the Y direction.

The pair of fastening holes 38A may be formed at the same height position as the reference height H and at positions where distances from the center position C are equal to each other. In addition, the fastening holes 38B are formed at positions higher than the reference height H and positions lower than the reference height H so as to have the same deviation amount in the 7, direction from the reference height H. The fastening holes 38B are formed such that distances from the center position C are equal. The fastening holes 38B may be formed at positions equidistant from the respective axes of the cylinder portions 21 adjacent to each other in the Y direction. That is, the fastening hole 38B may be formed at the center between the adjacent cylinder portions 21 in the Y direction.

The through-holes 68 include through-holes 68A opposing the fastening holes 38A and through-holes 68B opposing the fastening holes 38B. The through-holes 68A are formed at positions (both the ends in the Y direction) sandwiching the three cylinder portions 61 in the Y direction. Additionally, the through-holes 68A are located at positions sandwiching the reciprocating members 40 in the Y direction. Two through-holes 68B are formed in each portion between the cylinder portions 61 adjacent to each other in the Y direction.

The through-holes 68A and the fastening holes 38A formed at both the ends in the Y direction accommodate position regulating members 85. The position regulating member 85 regulates a relative position between the crankcase 10 and the manifold 60. For example, the position regulating member 85 regulates a position of the manifold 60 with respect to the crankcase 10 such that an axial center of the cylinder portion 21 and an axial center of the cylinder portion 61 coincide with each other.

The position regulating member 85 has a tubular shape having an axial direction along the X direction. In the example illustrated in FIG. 3, the position regulating member 85 has a cylindrical shape that extends along the X direction. An inner diameter and an outer diameter of the position regulating member 85 may be uniform over the entire region in the longitudinal direction. Such a position regulating member 85 can be held in a state of being fitted to a first fitting portion (e.g., fitting portion 39) formed in the fastening hole 38A and a second fitting portion (e.g., fitting portion 69) formed in the through-hole 68A. The fitting portion 39 accommodates a portion (e.g., a first end 85*a*) of the position regulating member 85 on the rear side in the X direction. The fitting portion 39 is a columnar space having an axis common to that of the fastening hole 38A, and has an inner diameter larger than an inner diameter of the fastening hole 38A. The inner diameter of the fitting portion 39 may be substantially the same as the outer diameter of the position regulating member 85. The fitting portion 39 is formed at a front end of the fastening hole 38A. The front end faces the manifold 60.

The fitting portion 69 accommodates a portion (e.g., a second end 85*b*) of the position regulating member 85 on the front side in the X direction. The fitting portion 69 is a columnar space having an axis common to that of the through-hole 68A, and has an inner diameter larger than an inner diameter of the through-hole 68A. The inner diameter of the fitting portion 69 may be substantially the same as the outer diameter of the position regulating member 85. The fitting portion 69 is formed at a rear end of the through-hole 68A. The rear end faces the crankcase 10. The fitting portion 39 and the fitting portion 69 are formed to face each other and mutually share the axis. In the example illustrated in FIG. 3, the inner diameter of the fitting portion 39 may be slightly smaller than the inner diameter of the fitting portion 69. When the position regulating member 85 is fitted to the fitting portion 39 and the fitting portion 69, a force at the time of fitting the position regulating member 85 to the fitting portion 39 may be larger than a force at the time of fitting the position regulating member 85 to the fitting portion 69. A force for removing the position regulating member 85 from the fitting portion 39 may be larger than a force for removing the position regulating member 85 from the fitting portion 69. The length of the fitting portion 39 in the X direction may be longer than the length of the fitting portion 69 in the X direction.

The fitting portion 39 and the fitting portion 69 are formed in the fastening hole 38A and the through-hole 68A formed at each of both the ends in the Y direction. When viewed from the X direction, the position regulating members 85 are disposed at a point-symmetrical positions with the center position C as a reference, and are disposed on a line (e.g., at the reference height H) along the Y direction passing through the center position C. In addition, a pair of the position regulating members 85 is disposed at positions sandwiching the plurality of reciprocating members 40 in the Y direction.

The fastening member 81 has the first coupling portion 81*a* (e.g., threaded portion), the second coupling portion 81*b* (e.g., head portion), and an insertion portion 81*c* (e.g., shaft portion) inserted in the position regulating member 85. The insertion portion 81*e* is located between the first coupling portion 81*a* and the second coupling portion 81*b*. The first coupling portion 81*a* extends from the first end 85*a* of the position regulating member 85 and is threaded to the fastening hole 38A of the crankcase 10. The second coupling portion 81*b* abuts the manifold 60. The second coupling portion 81*b* clamps the manifold 60 between the second coupling portion 81*b* and the crankcase 10 by screwing the first coupling portion 81*a* into the fastening hole 38A.

As illustrated in FIG. 4, the manifold 60 has the through-holes 68 including first through-holes 68B and second through-holes 68B. The first through-holes 68B are located between the reciprocating members 40 adjacent in the Y direction. The second through-holes 68A are formed at both of the ends in the Y direction and are located as sandwiching the reciprocating members 40.

The fastening member 81 passes through the through-hole 68B and is fastened to the fastening hole 38B corresponding to the through-hole 68B. The fastening member 81 passes through the through-hole 68A formed at each of both the ends in the Y direction, and is fastened to the fastening hole 38A corresponding to the through-hole 68A to which the position regulating member 85 is fitted in the state of being inserted into the inside of the position regulating member 85. In a mode of operation where the crankcase 10) and the manifold 60 are fastened by the fastening member 81, the oil seal 26 is pressed and fixed to the stepped surface 21*a* inside the crankcase 10 via the seal case 73 and the positioning member 28. The U-packing 72 is sandwiched and fixed between the stepped surface 78 of the seal case 73 and the positioning member 28. The U-packing 71 is sandwiched and fixed between the end 74 of the seal case 73 on the side closer to the pump chamber 4 and the stepped surface 76 inside the manifold 60.

The reciprocating pump 1 illustrated in FIG. 1 or FIG. 2, includes the crankcase 10 having the reciprocating member 40 which reciprocates along the X direction, the manifold 60 having the cylinder portion 61 through which at least a part of the reciprocating member 40 of the crankcase 10 is inserted, the fastening member 81 which fastens the crankcase 10 and the manifold 60, and the position regulating member 85 which regulates a position of the manifold 60 with respect to the crankcase 10. The position regulating member 85 has the tubular shape having the axial direction along the X direction. The first end 85*a* of the position regulating member 85 is fitted to the fitting portion 39 formed in the crankcase 10. The second end 85*b* of the position regulating member 85 is fitted to the fitting portion 69 formed in the manifold 60. The fastening member 81 fastens the crankcase 10 and the manifold 60 in the state of being inserted into the position regulating member 85 having the tubular shape.

In some examples, the first end 85*a* and the second end 85*b* of the position regulating member 85 are fitted to the fitting portion 39 provided in the crankcase 10 and the fitting portion 69 provided in the manifold 60, respectively, to position the crankcase 10 and the manifold 60. The crankcase 10 and the manifold 60 are fastened by inserting the fastening member 81 into the position regulating member 85. The fitting portion 39 and the fitting portion 69 also serve as insertion holes of the fastening member 81. Since a dedicated region for the position regulating member 85 is not provided, an increase in sizes of the manifold 60 and the crankcase 10 may be suppressed.

The crankcase 10 includes the plurality of (e.g., three or more) reciprocating members 40 disposed at equal intervals in the Y direction intersecting the X direction. When viewed from the X direction, the pair of position regulating members 85 may be disposed at point-symmetrical positions with the center position C between the pair of reciprocating members 40 disposed at both the ends in the Y direction as the reference. The pair of position regulating members 85 may be disposed on a line (e.g., positions at the reference height H) passing through the center position C along the Y direction when viewed from the X direction. The pair of the position regulating members 85 may be disposed at positions sandwiching the plurality of reciprocating members 40 in the Y direction. The plurality of reciprocating members 40 may be disposed between the pair of position regulating members 85 in the Y direction. In these configurations, the occurrence of misalignment in assembly of the crankcase 10 and the manifold 60 is suppressed, and thus, uneven wear of the U-packing 71 and the like may also be suppressed.

The position regulating member 85 may have a cylindrical shape. The fitting portion 39 and the fitting portion 69 may have a columnar space. The diameter of the fitting portion 39 may be configured to be smaller than the diameter of the fitting portion 69 such that when the crankcase 10 and the manifold 60 are disassembled, the position regulating member 85 tends to remain in the fitting portion 39. The position regulating member 85 illustrated in the exploded perspective view of FIG. 4, is fitted to the fitting portion of the crankcase 10. A user may readily handle the detached manifold 60, and burden of maintenance work may be reduced. In some examples in which the crankcase 10 and the position regulating member 85 are separate bodies, even when the position regulating member 85 is damaged or the like, the reciprocating pump may be continuously used just by replacing only the position regulating member 85 without replacing the crankcase 10. In other examples, the position regulating member 85 and the crankcase 10 may be integrally formed together.

As illustrated in FIG. 4, the plurality of reciprocating members 40 are spaced apart from each other at equal intervals in the Y direction. One of the pair of the position regulating members 85 is a first position regulating member 85 and the other is a second a first position regulating member 85. A first fastening member 81 is inserted into the first position regulating member 85 and a second fastening member 81 is inserted into the first position regulating member 85. The plurality of reciprocating members 40 are located between the first position regulating members 85 and the second position regulating members 85 in the second direction. One of the reciprocating members 40 is centrally located between the first position regulating member 85 and the second position regulating member 85.

Figure 5:
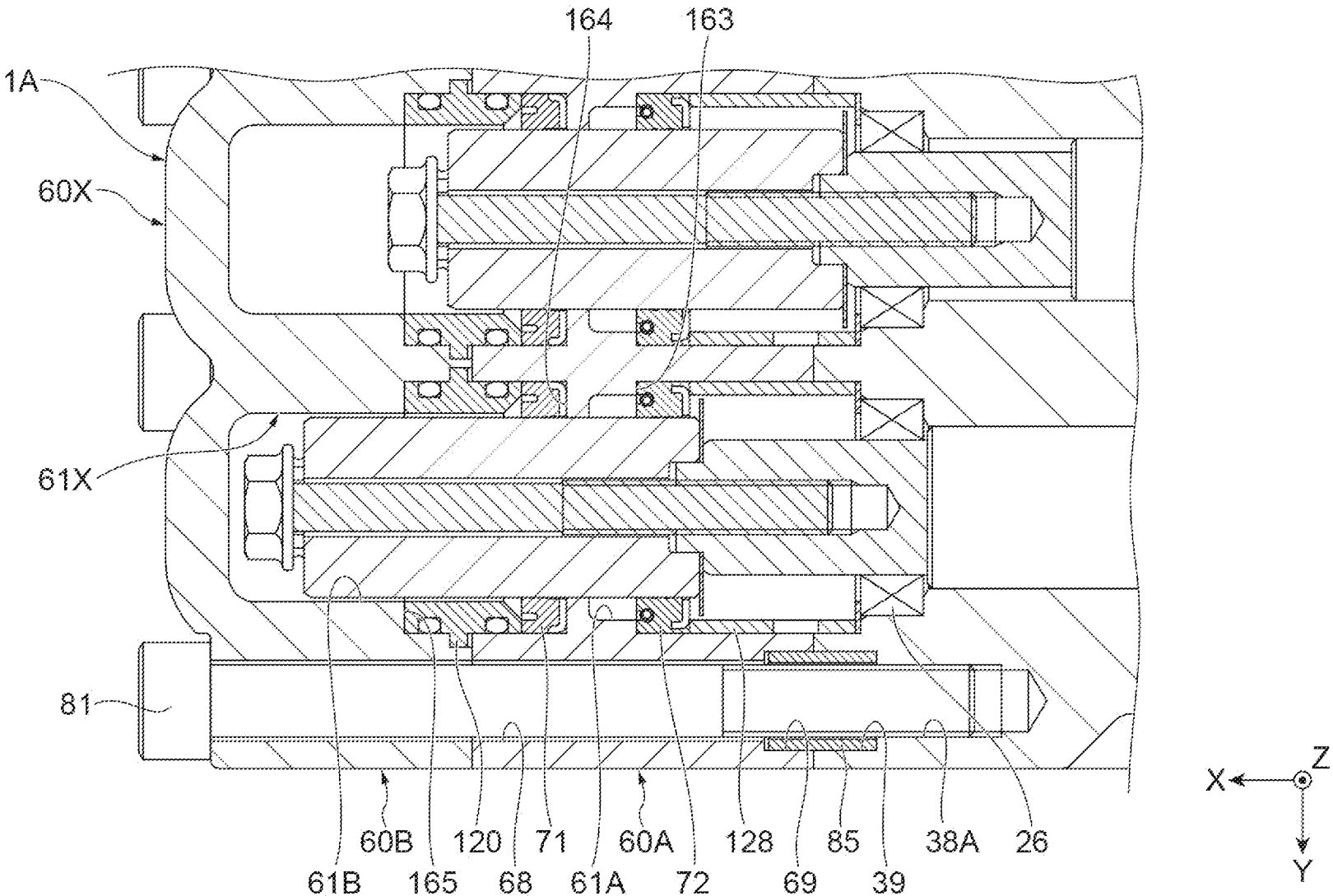
FIG. 5 is a cross-sectional view of another example reciprocating pump.

FIG. 5 is a cross-sectional view of another example reciprocating pump 1A. The reciprocating pomp 1A illustrated in FIG. 5, has a manifold 60X. The manifold 60X includes a first manifold 60A fastened to the crankcase 10 and a second manifold 60B connected to the first manifold 60A. The manifold 60X has a cylinder portion 61X. The cylinder portion 61X includes a first divided portion 61A and a second divided portion 61B. The first divided portion 61A is provided on the first manifold 60A. The second divided portion 61B is provided on the second manifold 60B. The first divided portion 61A and the second divided portion 61B are fluidly coupled to each other via a communication pipe 120.

The U-packing 71 positioned in the X direction by the communication pipe 120 is disposed in the first divided portion 61A of the first manifold 60A. The communication pipe 120 is fitted between a step 165 formed in an opening of the second divided portion 61B of the second manifold 60B and a step 164 of an opening on the front side of the first divided portion 61A of the first manifold 60A. The U-packing 72 is disposed on a step 163 formed in an opening of the first divided portion 61A of the first manifold 60A. The U-packing 72 is positioned by a seal retainer 128 having a tubular shape and disposed between the U-packing 72 and the oil seal 26. The seal retainer 128 also positions the oil seal 26. The first manifold 60A and the second manifold 60B cooperate to form the through-hole 68. The position regulating member 85 is held by the fitting portion 39 formed in the fastening hole 38A and the fitting portion 69 formed in the through-hole 68 of the first manifold 60A. In the example illustrated in FIG. 5, a seal case for accommodating the U-packing 71 inside may not be required, and thus, an increase in a size of the manifold 60 may be suppressed. In a case where only the U-packing 71 is replaced, only the second manifold 60B can be removed while the crankcase and the first manifold 60A are connected by the position regulating member 85, and thus, trouble of maintenance may be reduced.

Although the example in which the manifold and the crankcase are fastened by the six fastening members has been described, the number of fastening members is not particularly limited. For example, in a reciprocating pump provided with three reciprocating members, a manifold and a crankcase may be fastened by eight fastening members by forming two through-holes 68A and two fastening holes 38A in the Z direction similarly to the through-holes 68B and the fastening holes 38B. In some examples, position regulating members may be accommodated in, for example, a through-hole and a fastening hole on the upper side of one end in the Y direction and a through-hole and a fastening hole on the lower side of the other end in the Y direction so as to be point-symmetrical about the center position C.

Some additional examples are disclosed as follows, with continued reference to the drawings for convenience of description.

An example reciprocating pump (1, 1A) includes a crankcase (10), a manifold (60) connected to the crankcase (10), a reciprocating member (40) located in the crankcase (10) and the manifold (60) and configured to reciprocate along a first direction (X), a tubular position regulating member (85) extending along the first direction, and a fastening member (81) inserted in the position regulating member (85) and configured to fasten the crankcase (10) and the manifold (60). The position regulating member (85) includes a first end (85*a*) fitted in a first fitting portion of the crankcase (10) and a second end (85*b*) opposite the first end (85*a*) in the first direction and fitted in a second fitting portion of the manifold (60).

The fastening member (81) may include a first coupling portion (81*a*) extending from the position regulating member (85) in the first direction and configured to be threaded to the crankcase (10), a second coupling portion (81*b*) configured to clamp the manifold (60) between the second coupling portion (81*b*) and the crankcase by screwing the first coupling portion (81*a*) into the crankcase (10), and an insertion portion (81*c*) located between the first coupling portion (81*a*) and the second coupling portion (81*b*) and inserted in the position regulating member (85).

The reciprocating pump (1, 1A) may include position regulating members (85) and reciprocating members (40). The position regulating members (85) are located in the second direction (Y) orthogonal to the first direction (X). The reciprocating members (40) are located in the second direction (Y) and between the position regulating members (85).

The crankcase (10) may include a case cylinder portion (21) configured to form a part of a space in which the reciprocating member (40) reciprocates. The manifold (60) may include a manifold cylinder portion (61) fluidly coupled with the case cylinder portion (21) and is configured to form a part of the space in which the reciprocating member (40) reciprocates.

The reciprocating pump (1, 1A) may include a seal case (73) located in the manifold cylinder portion (61) so as to surround a part of the reciprocating member (40), and a packing (72) located between the seal case (73) and the reciprocating member (40).

The reciprocating pump (1, 1A) may include a positioning member (28) located in the case cylinder portion (21) so as to surround a part of the reciprocating member (40) and to abut the packing (72), and a seal portion (26) located in the case cylinder portion (21) so as to surround a part of the reciprocating member (40) and sandwiched between the positioning member (28) and the case cylinder portion (21). The seal case (73) may include a stepped surface (78) which abuts the packing (72) and may be configured to sandwich the packing (72) between the seal case (73) and the positioning member (28).

The reciprocating pump (1, 1A) may include a seal member (71) located in the manifold cylinder portion (61) adjacent the seal case (73) and surrounding a part of the reciprocating member (40) so as to abut the reciprocating member (40).

The manifold cylinder portion (61) may include a first divided portion (61A), a second divided portion (61B) fluidly coupled with the first divided portion (61A), and a communication pipe (120) inserted in and fluidly coupling the first divided portion (61A) and the second divided portion (61B).

What is claimed is:

1. A reciprocating pump comprising:

a case body including a reciprocating member configured to reciprocate along a first direction;

a manifold including a cylinder portion configured to allow insertion of at least a part of the reciprocating member of the case body;

a first fastening member configured to fasten the case body and the manifold to each other; and a position regulating member configured to regulate a position of the manifold with respect to the case body, wherein the position regulating member has a tubular shape extending along the first direction, and comprises a first end and a second end opposite the first end in the first direction, wherein the case body comprises a first fitting portion fitted to the first end, a threaded fastening hole to which the first fastening member is fastened, and a first stepped portion formed between the first fitting portion and the threaded fastening hole, wherein the first stepped portion includes a first contact surface perpendicular to the first direction and directly contacting the first end, wherein the manifold comprises a second fitting portion fitted to the second end, a through hole through which the first fastening member is inserted, and a second stepped portion formed between the second fitting portion and the through hole, wherein the second stepped portion includes a second surface perpendicular to the first direction and directly contacting the second end, wherein a diameter of the first fitting portion is smaller than a diameter of the second fitting portion, wherein a position of the position regulating member is fixed between the first fitting portion and the second fitting portion in the first direction, and wherein the first fastening member is inserted into the position regulating member to fasten the case body and the manifold to each other.

2. The reciprocating pump according to claim 1, wherein the first fastening member comprises:

a threaded portion extending from the first end of the position regulating member and threaded to the threaded fastening hole; and a head portion configured to clamp the manifold between the head portion and the case body by screwing the threaded portion into the threaded fastening hole.

3. The reciprocating pump according to claim 1, wherein the reciprocating member comprises a plurality of reciprocating members, and wherein the plurality of reciprocating members are spaced apart from each other at equal intervals in a second direction that is orthogonal to the first direction.

4. The reciprocating pump according to claim 3, wherein the position regulating member comprises a first position regulating member and a second position regulating member, wherein the second position regulating member is configured to regulate the position of the manifold with respect to the case body, and wherein the plurality of reciprocating members are located between the first position regulating member and the second position regulating member in the second direction.

5. The reciprocating pump according to claim 4, further comprising a second fastening member configured to fasten the case body and the manifold to each other, wherein the second position regulating member has a tubular shape into which the second fastening member is inserted.

6. The reciprocating pump according to claim 4, wherein one of the plurality of reciprocating members is centrally located between the first position regulating member and the second position regulating member in the second direction.

7. The reciprocating pump according to claim 1, wherein the position regulating member has a cylindrical shape, and wherein the first fitting portion and the second fitting portion have a columnar space.

8. The reciprocating pump according to claim 1, wherein a length of the first fitting portion in the first direction is longer than a length of the second fitting portion in the first direction.

9. A reciprocating pump comprising:

a crankcase;

a manifold connected to the crankcase;

a reciprocating member located in the crankcase and the manifold and configured to reciprocate along a first direction;

a tubular position regulating member extending along the first direction, wherein the position regulating member includes a first end fitted in a first fitting portion of the crankcase and a second end opposite the first end in the first direction and fitted in a second fitting portion of the manifold, wherein a diameter of the first fitting portion is smaller than a diameter of the second fitting portion; and a fastening member inserted in the position regulating member and configured to fasten the crankcase and the manifold, wherein the first end of the position regulating member includes a first flat end surface perpendicular to the first direction, and the second end of the position regulating member includes a second flat end surface perpendicular to the first direction, wherein the first fitting portion includes a first stepped surface that is perpendicular to the first direction, and the second fitting portion includes a second stepped surface that is perpendicular to the first direction, wherein both the first flat end surface of the position regulating member directly contacts the first stepped surface of the first fitting portion in the first direction, and the second flat end surface of the position regulating member directly contacts the second stepped surface of the second fitting portion in the first direction, and wherein a position of the position regulating member is fixed between the first fitting portion and the second fitting portion in the first direction.

10. The reciprocating pump according to claim 9, wherein the fastening member comprises:

a first coupling portion extending from the position regulating member in the first direction and configured to be threaded to the crankcase;

a second coupling portion configured to clamp the manifold between the second coupling portion and the crankcase by screwing the first coupling portion into the crankcase; and an insertion portion located between the first coupling portion and the second coupling portion and inserted in the position regulating member.

11. The reciprocating pump according to claim 9, wherein the position regulating member comprises a plurality of position regulating members, and the reciprocating member comprises a plurality of reciprocating members, wherein the plurality of position regulating members are located in a second direction orthogonal to the first direction, and wherein the plurality of reciprocating members are located in the second direction and between the plurality of position regulating members.

12. The reciprocating pump according to claim 9, wherein the crankcase comprises a case cylinder portion configured to form a first part of a space in which the reciprocating member reciprocates, and wherein the manifold comprises a manifold cylinder portion connected to the case cylinder portion and that is configured to form a second part of the space in which the reciprocating member reciprocates.

13. The reciprocating pump according to claim 12, further comprising:

a seal case located in the manifold cylinder portion so as to surround a part of the reciprocating member; and a packing located between the seal case and the reciprocating member.

14. The reciprocating pump according to claim 13, further comprising:

a positioning member located in the case cylinder portion so as to surround a part of the reciprocating member and to abut the packing; and a seal portion located in the case cylinder portion so as to surround the part of the reciprocating member and sandwiched between the positioning member and the case cylinder portion, wherein the seal case includes a stepped surface which abuts the packing and is configured to sandwich the packing between the seal case and the positioning member.

15. The reciprocating pump according to claim 14, further comprising a seal member located in the manifold cylinder portion adjacent the seal case and surrounding the part of the reciprocating member so as to abut the reciprocating member.

16. The reciprocating pump according to claim 9, wherein the crankcase further comprises a threaded fastening hole to which the fastening member is fastened, and the first stepped surface is formed between the first fitting portion and the threaded fastening hole, and wherein the manifold further comprises a through hole through which the fastening member is inserted, and the second stepped surface is formed between the second fitting portion and the through hole.

* * * * *